US009884739B2

(12) United States Patent
Pilar

(10) Patent No.: US 9,884,739 B2
(45) Date of Patent: Feb. 6, 2018

(54) METHOD FOR REMOVAL OF YARN, ESPECIALLY FAULTY YARN, FROM INTER-STORAGE OF YARN AT OPERATING UNIT OF TEXTILE MACHINE AND DEVICE FOR CARRYING OUT THE METHOD

(71) Applicant: Rieter CZ s.r.o., Usti nad Orlici (CZ)

(72) Inventor: Evzen Pilar, Litomysl (CZ)

(73) Assignee: Rieter CZ s.r.o., Usti nad Oriici (CZ)

( * ) Notice: Subject to any disclaimer, the term of this patent is extended or adjusted under 35 U.S.C. 154(b) by 448 days.

(21) Appl. No.: 14/575,146

(22) Filed: Dec. 18, 2014

(65) Prior Publication Data

US 2015/0175380 A1 Jun. 25, 2015

(51) Int. Cl.
*B65H 51/22* (2006.01)

(52) U.S. Cl.
CPC ..... *B65H 51/22* (2013.01); *B65H 2701/31* (2013.01)

(58) Field of Classification Search
CPC ..... B65H 73/00; B65H 51/22; B65H 51/20; B65H 51/26; B65H 51/02; B65H 51/04; B65H 51/06; B65H 59/10; B65H 59/18; B65H 2701/31; D01H 1/385; D01H 1/38; D01H 13/10; D01H 13/104; D01H 13/14; D01H 13/22; D01H 54/86; D01H 54/88
USPC ..... 28/297, 298, 292
See application file for complete search history.

(56) References Cited

U.S. PATENT DOCUMENTS 869,856 A * 10/1907 Leathers ..... B65H 73/00 28/297
993,422 A * 5/1911 Walker ..... B65H 73/00 28/298
1,067,614 A * 7/1913 Lonzo ..... B65H 73/00 28/298
1,514,924 A * 11/1924 Pfeiffer ..... B65H 73/00 28/298
2,832,124 A * 4/1958 Haas ..... B65H 73/00 28/294
3,298,078 A * 1/1967 Henri-Leopold ..... B65H 73/00 28/297
3,803,673 A * 4/1974 Kupper ..... B65H 73/00 28/294
4,028,911 A * 6/1977 Fecker ..... D04B 15/482 242/364.5

(Continued)

FOREIGN PATENT DOCUMENTS

CZ 1990-4622 12/1991
CZ PV 2012-479 6/2013

(Continued)

OTHER PUBLICATIONS

EP Search Report, dated May 8, 2015.
Search Report—Czech Republic—dated May 16, 2014.

*Primary Examiner* — Amy Vanatta
(74) *Attorney, Agent, or Firm* — Dority & Manning, P.A.

(57) ABSTRACT

The invention relates to a device and method for removal of yarn, especially faulty yarn, from an inter-storage at an operating unit of a textile machine. The yarn to be removed from the drum of the drum inter-storage is moved from the drum by a force exerted in the direction of the longitudinal axis of the drum towards the end of the drum and/or outside the drum, from where the yarn is sucked off.

10 Claims, 3 Drawing Sheets

(56) References Cited

U.S. PATENT DOCUMENTS

| | | | | | |
|---|---|---|---|---|---|
| 4,097,976 | A * | 7/1978 | Ferguson | B65H 73/00 | 28/297 |
| 4,132,056 | A * | 1/1979 | Husges | B65H 51/22 | 242/364.9 |
| 4,133,207 | A | 1/1979 | Weidmann et al. | | |
| 4,451,007 | A * | 5/1984 | Ohkubo | B65H 54/553 | 242/476.1 |
| 4,553,709 | A * | 11/1985 | Bock | B65H 51/22 | 242/364.8 |
| 4,695,002 | A * | 9/1987 | Raasch | B65H 51/22 | 242/365.3 |
| 4,817,425 | A | 4/1989 | Ueda et al. | | |
| 5,170,822 | A * | 12/1992 | Josefsson | D03D 47/363 | 139/452 |
| 5,224,330 | A * | 7/1993 | Stahlecker | B65H 51/22 | 242/474 |
| 5,443,165 | A * | 8/1995 | Hasui | B65H 67/062 | 209/602 |
| 5,671,783 | A | 9/1997 | Zenoni et al. | | |
| 2014/0034770 | A1 * | 2/2014 | Sloupensky | B65H 51/22 | 242/364.9 |

FOREIGN PATENT DOCUMENTS

| | | | |
|---|---|---|---|
| DE | 27 20 281 | | 5/1978 |
| DE | 37 13 783 | A1 | 10/1987 |
| DE | 37 36 926 | A1 | 5/1989 |
| EP | 0 179 178 | A1 | 4/1986 |
| EP | 1 132 510 | A2 | 9/2001 |
| EP | 2 354 069 | A2 | 8/2011 |
| JP | 6144792 | S | 10/1979 |
| JP | S60199929 | A | 10/1985 |
| JP | H02277855 | A | 11/1990 |
| JP | H04257348 | A | 9/1992 |
| JP | H07118959 | A | 5/1995 |
| JP | H09157907 | A | 6/1997 |
| JP | H1059622 | A | 3/1998 |
| WO | WO 2012/176041 | A2 | 12/2012 |

* cited by examiner

METHOD FOR REMOVAL OF YARN, ESPECIALLY FAULTY YARN, FROM INTER-STORAGE OF YARN AT OPERATING UNIT OF TEXTILE MACHINE AND DEVICE FOR CARRYING OUT THE METHOD

TECHNICAL FIELD

The invention relates to a method for removal of yarn, especially faulty yarn, from an inter-storage of yarn at an operating unit of a textile machine, where the inter-storage comprises a pivotably mounted driven drum with a working surface.

The invention also relates to a device for the removal of yarn, especially faulty yarn, from an inter-storage of yarn at an operating unit of a textile machine, where the drum inter-storage comprises a pivotably mounted driven drum with a working surface.

BACKGROUND ART

Yarn intermediate storage devices in textile machines are used particularly for compensating differences between the speed of yarn being drawn-off from the working body and the speed of yarn being wound on a bobbin. For example, they are used for compensating differences between the speed of yarn being drawn-off from a body for creating yarn, such as from a spinning rotor or a spinning nozzle, and the speed of yarn being wound on a bobbin.

Intermediate storage devices of yarn which are currently used vary in construction and are therefore based on different principles of operation.

Known are the so-called drum inter-storage devices that derive benefit from the fact that at one end of their working surface, yarn is continuously wound on their working surface, whereas at the other end of their working surface, yarn is continuously unwound from this working surface, and, consequently, yarn is continuously rewound over the working surface of the drum inter-storages. However, if, for example, yarn with a defect is wound on the drum inter-storage, the faulty yarn has to be removed. Nowadays, this is carried out by unwinding the defective yarn portion to the yarn waste by means of a suction nozzle being close to the slowly revolving drum inter-storage, whereby the faulty yarn is gradually unwound from the drum and the unwound faulty yarn is gradually sucked into the yarn waste, as is shown in FIG. 1.

The disadvantage of the background art is the fact that the process of unwinding the defective yarn portion is relatively lengthy (time demanding), wherein during this process, the other working bodies of the operating unit have to interrupt their operation. For example, it is necessary to interrupt the production of yarn, etc. Another drawback is the fact that removal of yarn from the inter-storage by unwinding has limited success, which causes problems during subsequent operations at the operating unit, such as resuming the spinning after a yarn rupture or after eliminating a defect, etc.

The goal of the invention is to eliminate or at least reduce the disadvantages of the background art, especially speed up removal of yarn from an inter-storage of yarn comprising a drum as a working surface, as well as improve the reliability of this process.

SUMMARY OF THE INVENTION

Additional objects and advantages of the invention will be set forth in part in the following description, or may be obvious from the description, or may be learned through practice of the invention.

The goal of the invention is achieved by a method for removal of yarn, especially faulty yarn, from an inter-storage of yarn at an operating unit of a textile machine, whose principle consists in that the yarn which is to be removed from the inter-storage is moved by the force exerted in the direction of the longitudinal axis of the drum towards the end of the inter-storage and/or outside the inter-storage from where the yarn is removed.

The principle of the device for carrying out the method for removal of yarn, especially faulty yarn, from an inter-storage of yarn at an operating unit of a textile machine, consists in that to the working surface of the inter-storage there are assignable power means for moving the yarn from the inter-storage in the direction of the longitudinal axis of the inter-storage towards the end of the inter-storage and/or outside the inter-storage, to where is assignable means for removal of the yarn.

The advantage of this invention is in achieving fast and reliable removal of the yarn from the drum of an inter-storage of yarn.

DESCRIPTION OF THE DRAWINGS

The invention is schematically represented in the following drawings.

SPECIFIC DESCRIPTION

Figure 1:
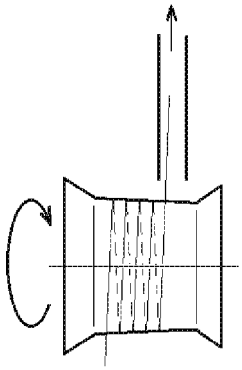
Fig. 1 (Prior Art)
FIG. 1 shows a method for removal of the yarn from an inter-storage according to the background art, namely by suction the yarn off gradually while the drum is slowly rotating.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

The present invention will be described in an example of embodiment of an operating unit of a textile machine producing yarn 0 and winding the yarn 0 on a bobbin. The machine typically comprises at least one row of identical operating units arranged next to each other, each of which comprises means for producing yarn 0 and a winding device for winding up the produced yarn 0 on a bobbin. Between the means for producing yarn 0 and the winding device of the yarn 0 on the bobbin is located an inter-storage of the yarn 0. The inter-storage comprises an independently driven drum 1, which is pivotable about its longitudinal axis A, and an independently driven actuating arm (not shown), which is pivotable about the longitudinal axis A of the drum and is arranged in a radial direction of the drum. The drum 1 comprises a working surface 10 of the drum 1. At one end of the working surface 10 of the drum 1, the yarn 0 is continuously wound up on the working surface 10, whereas at the other end of the working surface 10 the yarn 0 is continuously unwound from this working surface 10. The yarn 0 is unwound with radial support of the actuating arm when the yarn 0 passes through the working portion of the actuating arm, while the yarn 0 is radially supported by the working portion of actuating arm above the end part of the working surface 10 of the drum 1.

Figures 2, 3, 4:
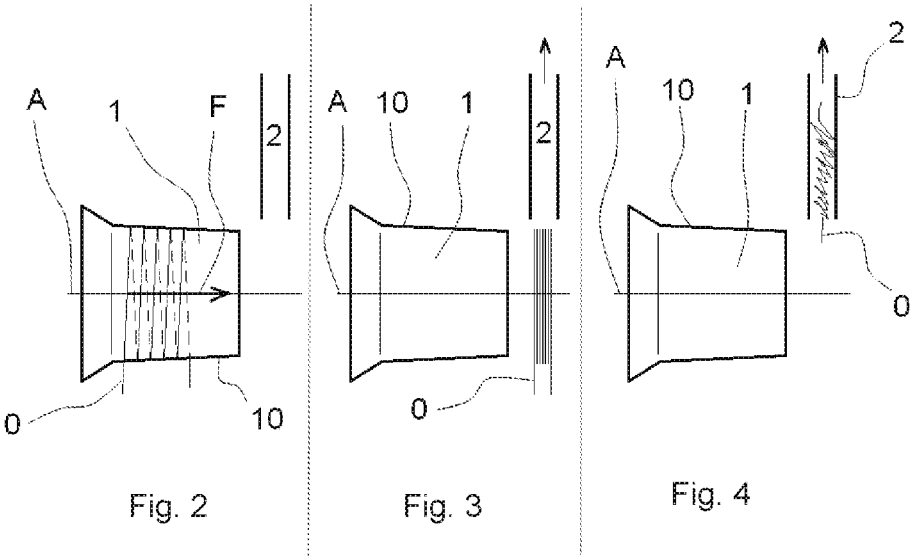
FIG. 2 shows initial phase of the method for removal of yarn from an inter-storage according to the invention.
FIG. 3 shows middle phase of the method for removal of yarn from an inter-storage according to the invention.
FIG. 4 shows final phase of the method for removal of yarn from an inter-storage according to the invention.

The method for removal of the yarn 0, especially faulty yarn 0, from an inter-storage of yarn 0 at an operating unit of a textile machine consists in that the yarn 0 which is to be removed from the drum 1 of the drum inter-storage is moved by the force F exerted in the direction of the longitudinal axis A of the drum 1 towards the end of the drum near the end edge 11 (FIG. 5) and/or is moved entirely outside the drum 1, as is seen in FIG. 3. From this location the yarn 0 is subsequently removed from the operating unit. In the illustrated embodiment, in this location outside the drum 1 is arranged either fixedly or adjustably a suction inlet of a suction pipe 2, by which the yarn is sucked off, as is shown in FIG. 4. The suction pipe 2 is coupled with an unillustrated underpressure source. In an unillustrated example of embodiment the yarn 0 is removed mechanically, etc.

For the purpose of moving the yarn 0 more easily by the force F exerted in the direction of the longitudinal axis A, it is advantageous if the yarn 0 is interrupted before and/or during and/or after being shifted towards the end of the drum 1 and/or outside the drum 1, namely especially at the point before entering the drum 1 and at the point after leaving the drum 1, for example by using suitable unillustrated means of interrupting the yarn, by which means a separate portion of the yarn is formed on the drum 1 to be sucked off.

Also, it is advantageous for moving the yarn 0 more easily by the force F exerted in the direction of the longitudinal axis A if the yarn 0 is slackened before and/or during and/or after being moved towards the end of the drum 1 and/or outside the drum 1. In the example of embodiment shown in FIGS. 2 to 4, the slackening of the yarn 0 on the drum 1 is achieved, for example, by using a drum 1 with a conical profile of the working surface 10, in which the slackening of the yarn 0 may occur virtually automatically after the yarn 0 is interrupted before and behind the drum 1 simply by slackening the tension in the yarn 0.

In another unillustrated embodiment, the slackening of the yarn on the drum 1 is achieved by using a drum 1 with an adjustable diameter of the working surface 10, or by a reducible length of the circumference of the working surface 10, for example by means of a longitudinally-divided working surface 10 of the drum 1, where at least one longitudinal part of the working surface 10 of the drum 1 is radially adjustable from its operating position in which the yarn 0 is wound over the revolving drum 1, into its slackening position more closely to the longitudinal axis A of the drum 1. In this embodiment, the working surface 10 of the drum 1 has either a cylindrical or conical profile, or, as the case may be, a slightly conical profile, for example similar to that in the preceding case. The ability of slackening the yarn 0 on the working surface 10 of the drum 1 may be enhanced by a suitable modification to the working surface 10 of the drum 1, for example by its low roughness and/or selected type of the surface finish etc. Optionally, the working surface 10 of the drum 1 is formed by a polyhedron, for example when the drum is composed of a system of wires and flat segments, etc., which by their outer surfaces define a substantially envelope rotary body constituting the working surface 10 of the drum 1.

The force F acting on the yarn 0 on the drum 1 in the direction of the longitudinal axis A of the drum 1 for moving the yarn 0 from the working surface 10 of the drum 1 towards the end of the drum 1 and/or outside the drum 1 is, according to one embodiment, exerted by a flow of compressed air directed towards the working surface 10 of the drum 1, namely either in the direction the longitudinal axis A of the drum 1, or it runs even crossways to it, e.g. at a slight angle in the order of degree units. In another unillustrated embodiment, the force F acting on the yarn 0 on the drum 1 in the direction of the longitudinal axis A of the drum 1 for moving the yarn 0 from the working surface 10 of the drum 1 towards the end of the drum 1 and/or outside the drum 1 is exerted due the effect of the air suction.

Figure 5:
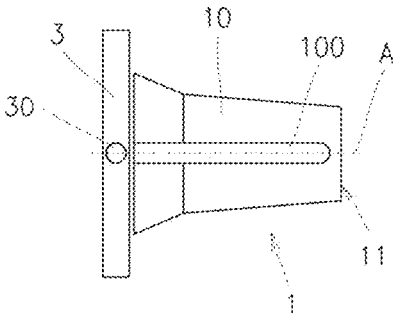
FIGS. 5 and 5*a* show an example of the embodiment of a mechanical stripper of yarn on the outer side of the drum having one radial arm.
Figure 5A:
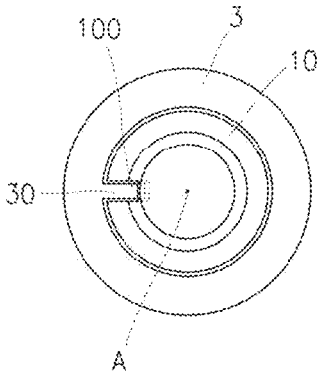

According to another embodiment, the force F acting on the yarn 0 on the drum 1 in the direction of the longitudinal axis A of the drum 1 for moving the yarn from the working surface of the drum 1 outside the profile of the drum 1 is exerted by a mechanical stripper, which is provided with at least one radial arm which intersects the working surface 10 of the drum 1 and which is, from the outer side of the working surface 10 of the drum 1, adjustable in the direction of the longitudinal axis A of the drum 1 along the length of the drum 1. As is shown in FIGS. 5 and 5*a*, the mechanical stripper in an advantageous embodiment has a shape of an annulus 3, through the center of which the drum 1 is able to pass when the yarn 0 is being stripped by the movement of the annulus 3 in the direction of the longitudinal axis A of the drum 1. In this embodiment the annulus 3 is provided with one radial arm 30 which intersects the working surface 10 of the drum 1 by fitting in a longitudinal groove 100 formed in the drum 1. In an unillustrated embodiment, the annulus 3, or, generally speaking, mechanical stripper, is provided with two or even more radial arms 30 moving in a direction transverse to the working surface 10 of the drum 1. By means of the radial arm 30, the mechanical stripper captures and strips the yarn 0, or, in other words, shifts or moves the yarn 0 to the respective area near the end of the drum and/or outside the drum 1 to the suction pipes 2, where the yarn is sucked off. In the illustrated embodiment, the annulus makes 3 a reciprocating rectilinear motion along the drum 1 and therefore the groove 100 in the drum 1 is rectilinear. In an unillustrated embodiment, the annulus 3 performs a reciprocating helical motion along the drum 1 and therefore the groove 100 of the drum 1 has a helical shape and a corresponding rising gradient.

As is shown in FIG. 5, the groove 100 ends at a certain distance from the rear edge 11 of the drum 1. This eliminates the possibility of forming an edge which might cause trapping the yarn 0.

According to another embodiment, the force F acting on the yarn 0 on the drum 1 in the direction of the longitudinal axis A of the drum 1 for moving the yarn 0 from the working surface 10 of the drum 1 outside the drum 1 is exerted by the mechanical stripper which is provided with at least one radial arm 30 which moves in a direction transverse to the working surface 10 of the drum 1 and which is arranged adjustably in the direction of the longitudinal axis A of the drum 1 in the inner part of the drum 1, whereby the working surface 10 of the drum 1 is provided with a passageway for the radial arm 30 of the stripper from the inner part of the drum 1 to the outer part of the drum 1. The radial arm 30 of the stripper is either radially adjustable and after the yarn 0 is stripped, it is adjusted so as not to protrude into the passageway of the working surface 10 of the drum 1, or the radial arms permanently protrude in this passageway of the working surface 10 of the drum 1 and in the idle mode they are located in a place where they do not interfere with the routine operation of the drum inter-storage, i.e. with the rewinding of the yarn 0 between the place of producing yarn 0 and that of winding the yarn 0 on the bobbin.

During emptying, due to the action of the force F, it is essential to ensure the motion of the yarn in relation to the drum 1 in the direction of the force F, which is in embodiments with mechanical stripper achieved by the motion of the drum 1 in relation to the stripper, which means that only one of them need move, while the other stands still, or both of them are moving. Also, in an embodiment with at least one airflow it is possible for the source of the force F and the drum 1 to move towards each other, which again means that only one of them need move, while the other stands still, or both of them are moving.

According to yet another embodiment, the force F acting on the yarn 0 on the drum 1 in the direction of the longitudinal axis A of the drum 1 for moving the yarn 0 from the working surface 10 of the drum 1 outside the drum 1 is exerted by a combination of at least two of the above-mentioned procedures, for example, by combining pneumatic and mechanical procedures and/or combining radially adjustable and radially rigid radial arms 30 of the stripper, including a combination with the pneumatic procedure, etc.

In an unillustrated embodiment, the drum 1, apart from being pivotably arranged about the axis A is also arranged reversibly tiltably in the direction perpendicular to the axis A of its rotation, whereby by being tilted in this manner from the operating position shown in the drawing, in which the drum 1 is used as an intermediate storage of yarn, the drum 1 is set in the emptying position in which the source of the force F is, for example, the arm 30 of the mechanical stripper moving in a direction transverse to the working surface of the drum 1 for shifting the yarn towards the end of the inter-storage or outside the inter-storage. In another unillustrated embodiment, after emptying the yarn from the drum 1, not only is the drum 1 tilted, but simultaneously also the source of the force F is set in relation to the drum 1 in the operating position, such as the mechanical stripper, i.e. both the elements perform the same motion to get into and from the emptying position of the drum 1, which is different from the operating position of the drum 1. In yet another unillustrated embodiment, the drum 1 remains all the time in the operating position and it is only the source of the force that is set in the emptying position. In another unillustrated embodiment, the drum 1 is aligned with a parallel longitudinal means around which the yarn is wound and at the same time it is wound around part of the working surface of the drum 1, which is therefore in this embodiment only partially wrapped by the yarn. Due to the radial mutual motion of the longitudinal means or the drum 1 it is then, for example, possible to slacken the yarn so as to remove it from the drum 1 by the force F exerted according to the invention.

In another unillustrated embodiment, the mechanical stripper comprises an annulus which revolves together with the drum and whose radial arm 30 or radial arms 30 are permanently situated in a position intersecting the working surface 10 of the drum 1, for example they are permanently arranged in a groove in the working surface 10 of the drum 1 in the case of a drum designed with a solid circumferential wall, etc.

Figure 6:
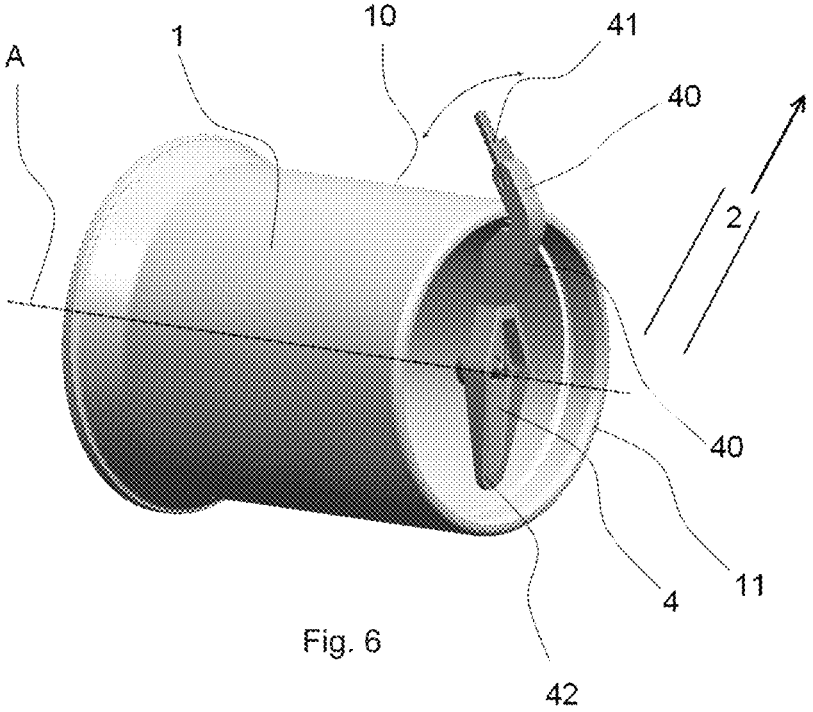
FIGS. 6 and 6*a* show an embodiment of a rotary arm.
Figure 6A:
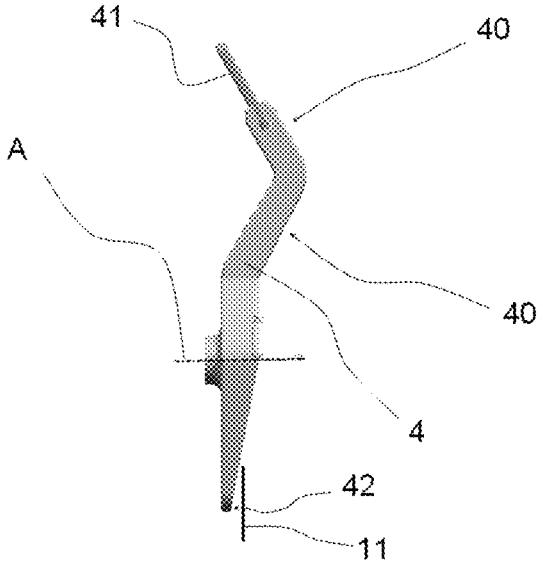

In the embodiment shown in FIGS. 6 and 6*a*, the drum 1 comprises a rotary arm 4 and a guide 41 of yarn, wherein the arm 4 has an optimized shape so that it would not interfere with the removal of the yarn by the force F exerted according to the invention, especially when the yarn is falling freely over the edge of the drum 1 for the subsequent removal of the yarn or when the yarn is sucked off from the location near the drum 1 or near the end of the drum 1, etc. For these purposes, the arm 4 in the illustrated embodiment has inclined areas 40 for sliding of the yarn, whereby during the removal of the yarn, the arm 4 is placed by the guide 41 in the direction of the yarn removal, i.e. in the direction of the yarn falling or being sucked off. The opposite end 42 of the arm 4 is situated substantially in the inner space of the drum 1, i.e. it is hidden behind the level of the rear edge 11 of the drum 1, and so during the removal of the yarn it does not hinder the free motion of the yarn in the direction of the yarn falling or being sucked off, etc.

From the above description it follows that there are numerous concrete constructional embodiments and variants to implement the invention described above, therefore the concrete constructional embodiments explicitly mentioned here do not limit the scope of the invention which is included in the patent claims.

Modifications and variations can be made to the embodiments illustrated or described herein without departing from the scope and spirit of the invention as set forth in the appended claims.

The invention claimed is:

1. A method for removal of yarn from an inter-storage device at an operating unit of a textile machine that is producing yarn, the inter-storage device having a driven drum with a working surface, the method comprising:

producing the yarn at the operating unit, wherein the inter-storage device is operationally disposed between a means at the operating unit for producing the yarn and a winding device that winds the produced yarn onto a bobbin;

winding the produced yarn onto the drum of the inter-storage device;

upon a fault in the yarn production or yarn winding, exerting a force on the yarn that is wound on the drum and intended to be removed, the force exerted along a longitudinal direction of the drum towards an end of the drum; and wherein the yarn is moved by the force to the end of drum or beyond the end of the drum from where the yarn is removed.

2. The method as in claim 1, wherein the yarn to be removed from the drum is separated from the yarn produced at the operating unit of the textile machine.

3. The method as in claim 1, further comprising slackening the yarn wound on the drum before or during application of the force.

4. The method as in claim 3, wherein the yarn is slackened by reducing a circumference of the working surface of the drum on which the yarn is wound.

5. The method as in claim 1, wherein the force is exerted by an airflow directed along the drum.

6. The method as in claim 1, wherein the force is exerted by a mechanical stripper that moves outside of the drum relative to a longitudinal axis of the drum to contact and move the yarn towards the end of the drum.

7. The method as in claim 1, wherein the force is exerted by a mechanical stripper disposed at least partially within the drum and movable to the working surface of the drum.

8. The method as in claim 1, wherein the force is exerted by a mechanical stripper having a radial arm that moves in a direction transverse to the working surface of the drum.

9. The method as in claim 1, wherein the drum is moved from an operating position to an emptying position prior to removal of the yarn.

10. The method as in claim 1, wherein during the yarn production, the yarn moves along a guide at an end of a radial arm that is located at the end of the drum, and during yarn removal, the radial arm and guide are moved to a yarn removal position.

* * * * *